United States Patent [19]

Robinson et al.

[11] 4,252,243

[45] Feb. 24, 1981

[54] CRANE SAFETY DEVICE

[75] Inventors: Frank M. Robinson; John K. Richardson, both of Hull, England

[73] Assignee: Priestman Brothers Limited, Hull, England

[21] Appl. No.: 2,971

[22] Filed: Jan. 12, 1979

[30] Foreign Application Priority Data

Jan. 19, 1978 [GB] United Kingdom ..... 2204/78

[51] Int. Cl.[3] ..... B66C 23/88

[52] U.S. Cl. ..... 212/149; 212/153

[58] Field of Search ..... 212/39 R, 39 B, 39 DB, 212/39 MS, 39 A, 39 D; 254/173 R

[56] References Cited

U.S. PATENT DOCUMENTS

| | | | |
|---|---|---|---|
| 3,035,712 | 5/1962 | Nowack | 212/39 MS |
| 4,109,798 | 8/1978 | Alastair | 212/39 R |

*Primary Examiner*—Robert G. Sheridan

*Attorney, Agent, or Firm*—Remy J. VanOphem

[57] ABSTRACT

A crane has a hoist rope which passes over a boom to a drum driven by a hudraulic motor and including a brake. The crane includes means for releasing the brake when the free end of the rope is a given distance below the crane, and has means for relieving hydraulic pressure from the motor in response to the horizontal radius of the free end of the rope so that at a given radius the motor can lift only a given maximum load.

6 Claims, 2 Drawing Figures

CRANE SAFETY DEVICE

FIELD OF THE INVENTION

The present invention relates to cranes and in particular to apparatus for preventing structural failure of a crane when the maximum safe overturning moment is exceeded.

BACKGROUND OF THE INVENTION

One of the major dangers for a crane operating from a sea platform for example and lifting from a ship, is that the load, hook or rope may get caught on the ship itself so that as the ship drops away in the trough of a wave its full weight is imposed on the crane causing fracturing of structural elements of the crane. It might be thought that the rope would fracture first, but the strength of a crane hoist rope is calculated to enable safe lifting of the heaviest load for which the crane is intended and this load is of course at a maximum when the hoist rope is at its smallest radius from the central point of the crane. Thus, while at the minimum radius the hoist rope is weaker than the crane structure, and when it is at maximum radius, for example in the case of a crane having an inclined boom when the boom is inclined at its greatest angle to the vertical, the hoist rope may be stronger than the boom, gantry and other structural elements. Thus, there may be a good chance that the rope will remain intact and that structural failure of the crane itself will occur if the maximum safe crane working load is exceeded.

SUMMARY OF THE INVENTION

In order to overcome this problem and in accordance with the present invention, a crane having a hoist rope which passes over a boom to a hoist drum driven by a hydraulic motor and including a brake therefore, includes means for releasing the brake when the free end of the hoist rope is at a given height, below the drum, and means for relieving hydraulic pressure from the motor in response to the horizontal radius of the free end of the hoist rope so that at a given radius the motor can lift only a given maximum load.

Thus, when the rope is below the drum at the given distance or greater, an imposed load greater than the permissible load will not be lifted, and if the ship drops relative to the crane, will unwind further rope from the drum against the action of the motor, due to relieving of pressure therefrom.

As any overload of the crane is transmitted through the hoist rope if the drum around which the rope is lapped can revolve under the action of that overload then failure of structural elements is prevented. Normally the drum is stopped from unwinding by a combination of the brake being on and a relief valve connecting the input and output sides of the hydraulic motor being closed to prevent the drum motor from revolving. By enabling automatic release of the brake and opening of the relief valve or valves, snagging of the hoist rope will not cause damage to the crane.

When the crane is of the type normally used on a sea platform, that is to say when the crane is mounted on the top of a pedestal and includes an inclined boom, the position of the free end of the hoist rope, or of the hook therefor is dependant upon the angle of the boom and the amount of rope unwound from the drum and can be measured by sensing the number of turns of the hoist drum from a given set position and combining a signal thus produced with a signal responsive to the angle of the boom to provide a composite signal which actuates release of the brake when the hook is below the platform a predetermined distance. Also, as the boom angle changes, the setting of drum motor relief valve can be varied so that maximum pressure in the hoist drum hydraulics is varied to produce only sufficient hydraulic pressure to enable lifting of the maximum load at any given boom radius.

The apparatus can be set so that if a hook or load is caught on a ship, no matter what the angle of the boom, the hoist rope will pull off the drum when a given overload is reached as the ship drops away. This overload may vary for example between 1.4 and 1.7 times the working load depending on the efficiencies of the motor and transmission and its level will change due to the change in the couple on the drum as the hoist rope is wound on the drum, due to the change in distance of the hoist rope on the drum from the drum axis.

The apparatus can be set to be completely automatic so as to be independent of driver operation. Thus, for example, if the ship sails away with the hook still attached, the rope would be pulled completely off the drum in a controlled manner, rather than pulling the crane off the platform.

The use of variable relief valves in the hydraulic system may enable impact loading to be greatly reduced as the hydraulics will now be able to absorb a large percentage of shock loading.

Where the crane includes main and a whip boom, apparatus can be provided to sense details from either boom as required using a switching circuit and a single processing unit for the signals from the sensors used to detect the distance of the end of the hoist rope below the drum and the radius of the hoist rope.

BRIEF DESCRIPTION OF THE DRAWINGS

One example of a crane according to the present invention will now be described with reference to the accompanying schematic drawings, in which.

DESCRIPTION OF THE PREFERRED EMBODIMENTS

Figure 1:
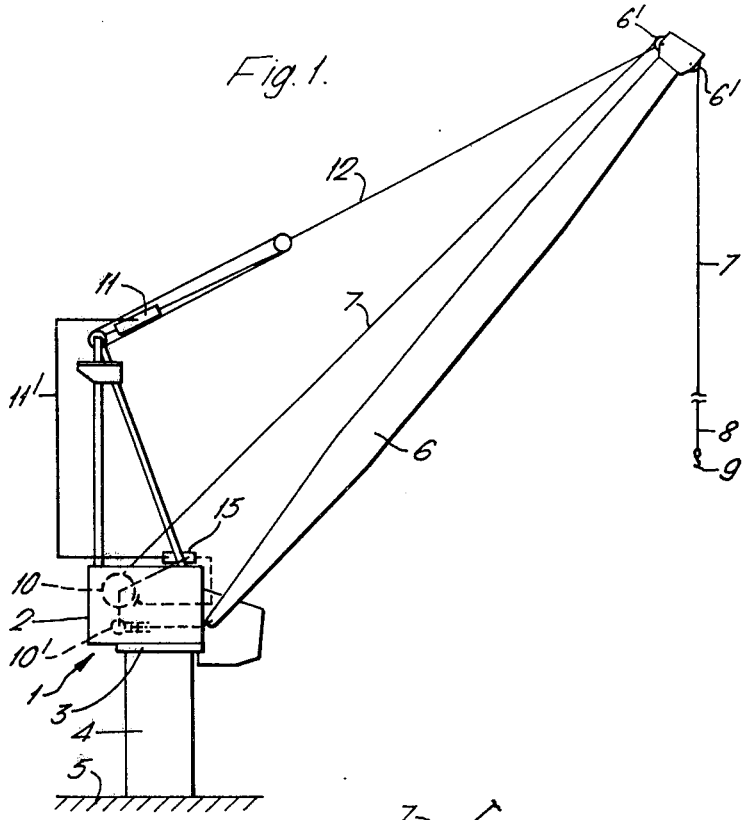
FIG. 1 is a general view of the crane.
Figure 2:
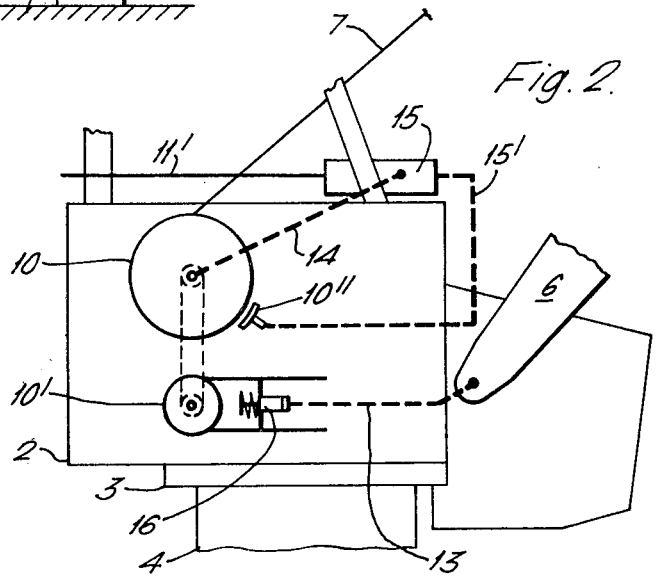
FIG. 2 is a detailed view.

The crane 1 has a body 2 rotatably mounted on a slewing ring 3 on the top of a pedestal 4 secured to the deck 5 of a sea platform such as an oil drilling rig. The crane 1 includes an inclined boom 6 the angle of inclination of which is variable as usual. The crane may also be fitted with a whip boom (not shown). A hoist rope 7 passes from its free end 8 at which is attached a hook 9, over the free end of the boom 6 around a pair of pulleys 6' and then to the hoist rope drum 10 mounted on the body 2 of the crane and driven by a hydraulic motor 10'.

The angle of the boom 6 to the vertical is measured by means of a sensor or indicator 11 such as a Wylie Pneumatic Safe Load Indicator which also measures the load in the derricking rope or boom rope 12 which controls the angle of the boom, so as to provide an indication of safe working load at any given angle of the boom 6. From the angle of the boom is provided the radius of the hoist rope 7 which is indicated to the driver of the crane 1 to aid operation under normal circumstances. The same signal passed, via line 11' to an activator as described below. An indication may also be provided of the actual load in the hoist rope 7, again to aid normal operation by the driver.

The number of revolutions of the hoist rope drum 10 from a given position are measured to determine the height of the free end 8 of the hoist rope 7 relative to the boom 6. The rope drum revolutions are measured via a worm drive 14 (indicated in broken line) coupled to an end of the drum shaft. The measurements of angle and rope drum revolutions are fed to an activating unit 15 where they are combined in such a manner that at a given height of the free end of the rope 7 there is produced a signal along line 15'. The signal actuates a pilot valve (not shown) which releases a hydraulic pressure-applied/spring - actuated brake 10'' on the hoist rope drum 10. This prevents the brake from holding the hoist rope 7 fixed when there is a load on the rope 7 which can overcome the force of the motor driving the drum 10.

The hydraulic motor includes, between the two sides of its hydraulic circuit, one or more pilot-operated pressure relief valves 16 of conventional construction. The relieving pressures of the valves 16 are varied by a further, pilot signal responsive to the boom angle. The angle of the boom is measured via a direct mechanical linkage 13 (indicated in broken line) to the boom, to ensure that only sufficient hydraulic power can be supplied to the motor to lift off a given maximum load at a given boom angle. The pilot signal is arranged so as to relieve pressure normally only when the hoist rope end is below the given distance below the deck. This allows for the rope to be pulled off the drum (at for example approximately 150% overload) if the hook snags on a ship. However, for lifting loads on the platform alone an override control may be provided to prevent pressure relieving of the motor.

As the safe working load of the crane will vary depending on the so called "sea state", the safe working load indicator of the driver can be arranged to indicate safe working loads dependent on a number of different sea states (usually determined by the average wave height) for additional safety.

The invention is, of course, equally applicable to fixed boom type cranes, but in these cases the position of the end of the hoist rope is dependent on the position of the hoist drum and the working radius as defined by the position of the travelling carriage on the boom.

What we claim is:

1. A crane safety device for protecting a crane having a horizontal platform against structural failure when the maximum safe crane working load is exceeded, said device comprising:

a boom having one end and an opposite end, said boom pivotably mounted at one end of said platform;

a hoist drum mounted on said platform and adjacent to said one end of said boom;

a hoist rope wound on said hoist drum and passing over said opposite end of said boom, said hoist rope having a free end, said free end hanging vertically from said opposite end of said boom;

a hydraulic motor rotatably driving said hoist drum;

a brake mounted adjacent to said hoist drum for engaging said hoist drum;

means for releasing said brake from engaging said hoist drum to permit the free rotation of said hoist drum and the unwinding of said hoist rope therefrom when said free end of said hoist rope hangs from said opposite end of said boom below said drum hoist such that when said hoist rope is connected to a load, said crane is protected from structural damage when the load exceeds said maximum safe working load of the crane; and means for relieving hydraulic pressure from said hydraulic motor in response to the horizontal radius of said free end of said hoist rope such that at a given radius said motor is limited to lifting a load which is below said maximum working load to protect said crane from structural damage.

2. A device according to claim 1, wherein said boom is an inclined boom, said inclined boom pivotably mounted to said platform forming varying angles to the vertical, and wherein said means for releasing said brake including means for sensing said varying angles of said boom so as to form a first signal, means for sensing the amount of said hoist rope unwound off said drum so as to form a second signal and means responsive to said two sensed signals so as to provide a third signal to release said brake when said aggregate of said first and second sensed signals correspond to the height of said free end of said hoist rope hanging from said opposite end of said boom below said drum hoist.

3. A device according to claim 1, wherein said means for relieving pressure from said hydraulic motor comprises at least one pilot-operated relief valve.

4. A device according to claim 3, wherein said at least one relief valve is operated only when said height of said free end of said hoist rope hangs from said opposite end of said boom below said drum hoist.

5. A device according to claim 4, wherein said at least one pressure relief valve is adapted to relieve pressure from said motor in response to the radius of said free end of said hoist rope so that the greater said radius of said free end of said hoist rope the greater said pressure relief and the lower said maximum load which can be lifted.

6. A device according to claim 5, wherein said boom is an inclined boom the angle of which can be varied, and wherein the radius of said free end of said hoist rope is determined by measuring said angle of said boom.

* * * * *